US008114274B2

(12) United States Patent
Moran et al.

(10) Patent No.: US 8,114,274 B2
(45) Date of Patent: Feb. 14, 2012

(54) METHOD FOR TREATING BITUMEN FROTH WITH HIGH BITUMEN RECOVERY AND DUAL QUALITY BITUMEN PRODUCTION

(75) Inventors: Kevin Moran, Edmonton (CA); George Cymerman, Edmonton (CA); Tom Tran, Edmonton (CA)

(73) Assignee: Syncrude Canada Ltd., Fort McMurray (CA)

( * ) Notice: Subject to any disclaimer, the term of this patent is extended or adjusted under 35 U.S.C. 154(b) by 264 days.

(21) Appl. No.: 12/177,050

(22) Filed: Jul. 21, 2008

(65) Prior Publication Data

US 2010/0012555 A1 Jan. 21, 2010

(51) Int. Cl.
*C10G 21/00* (2006.01)

(52) U.S. Cl. ..... 208/390; 208/391; 208/187; 208/400; 208/45

(58) Field of Classification Search ..... None
See application file for complete search history.

(56) References Cited

U.S. PATENT DOCUMENTS 4,514,305 A * 4/1985 Filby ..... 210/703
5,290,433 A 3/1994 Chan et al.
5,316,664 A * 5/1994 Gregoli et al. ..... 208/390
5,320,746 A * 6/1994 Green et al. ..... 208/391
5,968,349 A * 10/1999 Duyvesteyn et al. ..... 208/390
6,007,709 A * 12/1999 Duyvesteyn et al. ..... 208/391
6,214,213 B1 * 4/2001 Tipman et al. ..... 208/390
6,358,404 B1 3/2002 Brown et al.
6,746,599 B2 6/2004 Cymerman et al.
7,141,162 B2 * 11/2006 Garner et al. ..... 210/202
2010/0096297 A1 * 4/2010 Stevens et al. ..... 208/45

* cited by examiner

*Primary Examiner* — Tam M Nguyen
(74) *Attorney, Agent, or Firm* — Bennett Jones LLP

(57) ABSTRACT

A process for removing contaminants, namely water and particulate solids, from hydrocarbon diluent-diluted bitumen froth ("dilfroth") is provided to produce hydrocarbon diluent-diluted bitumen ("dilbit"), comprising subjecting the dilfroth to gravity settling in a primary settler to produce an overflow stream of primary raw dilbit, comprising bitumen containing water and some fine solids, and an underflow stream of primary tails, comprising solids, water and residual bitumen; removing the overflow stream of primary raw dilbit and subjecting it to gravity settling in a clarifier vessel for sufficient time to produce an overflow first stream of cleaned dilbit and an underflow stream of clarifier sludge; diluting the primary tails with hydrocarbon diluent and subjecting the diluted primary tails to gravity settling in a secondary settler to produce an overflow second stream of cleaned dilbit and an underflow stream of secondary tails; and removing the clarifier sludge and diluting the clarifier sludge with a hydrocarbon diluent, if necessary, and subjecting the clarifier sludge to gravity separation to produce a third stream of cleaned dilbit.

15 Claims, 5 Drawing Sheets

METHOD FOR TREATING BITUMEN FROTH WITH HIGH BITUMEN RECOVERY AND DUAL QUALITY BITUMEN PRODUCTION

FIELD OF THE INVENTION

The present invention relates generally to a bitumen froth treatment process for removing contaminants, namely water and particulate solids, from hydrocarbon diluent-diluted bitumen froth having reduced water and solids without unacceptable losses of bitumen. In one embodiment, two separate clean diluted bitumen streams are produced, a first stream comprising heavy bitumen having an API gravity less than about 10 and a second stream comprising lighter bitumen having an API gravity greater than about 10.

BACKGROUND OF THE INVENTION

Oil sand, as known in the Athabasca region of Alberta, Canada, comprises water-wet, coarse sand grains having flecks of a viscous hydrocarbon, known as bitumen, trapped between the sand grains. The water sheaths surrounding the sand grains contain very fine clay particles. Thus, a sample of oil sand, for example, might comprise 70% by weight sand, 14% fines, 5% water and 11% bitumen. (All % values stated in this specification are to be understood to be % by weight.) The bitumen recovered from Athabasca oil sand is generally very viscous and has an API gravity of less than 10 due to the large amount of heavy ends, such as kerosenes and asphaltenes. For a typical oil sand ore bitumen, with a density of 1002 kg/m3 at 20° C., the API gravity is 9.3.

For the past 25 years, the bitumen in Athabasca oil sand has been commercially recovered using a water-based process. In the first step of this process, the oil sand is slurried with process water, naturally entrained air and, optionally, caustic (NaOH). The slurry is mixed, for example in a tumbler or pipeline, for a prescribed retention time, to initiate a preliminary separation or dispersal of the bitumen and solids and to induce air bubbles to contact and aerate the bitumen. This step is referred to as "conditioning".

The conditioned slurry is then further diluted with flood water and introduced into a large, open-topped, conical-bottomed, cylindrical vessel (termed a primary separation vessel or "PSV"). The diluted slurry is retained in the PSV under quiescent conditions for a prescribed retention period. During this period, aerated bitumen rises and forms a froth layer, which overflows the top lip of the vessel and is conveyed away in a launder. Sand grains sink and are concentrated in the conical bottom. They leave the bottom of the vessel as a wet tailings stream containing a small amount of bitumen. Middlings, a watery mixture containing solids and bitumen, extend between the froth and sand layers.

The wet tailings and middlings are separately withdrawn, combined and sent to a secondary flotation process. This secondary flotation process is commonly carried out in a deep cone vessel wherein air is sparged into the vessel to assist with flotation. This vessel is referred to as the TOR vessel. The bitumen recovered by flotation in the TOR vessel is recycled to the PSV. The middlings from the deep cone vessel are further processed in induced air flotation cells to recover contained bitumen.

The froths produced by the PSV and flotation cells are combined and subjected to cleaning, to reduce water and solids contents so that the bitumen can be further upgraded. More particularly, it has been conventional to dilute this bitumen froth with a light hydrocarbon diluent, for example, with naphtha, to increase the difference in specific gravity between the bitumen and water and to reduce the bitumen viscosity, to thereby aid in the separation of the water and solids from the bitumen. This diluent diluted bitumen froth is commonly referred to as "dilfroth". It is desirable to "clean" dilfroth, as both the water and solids pose fouling and corrosion problems in upgrading refineries. By way of example, the composition of naphtha-diluted bitumen froth typically might have a naphtha/bitumen ratio of 0.65 and contain 20% water and 7% solids.

Separation of the bitumen from water and solids may be done by treating the dilfroth in a sequence of scroll and disc centrifuges. Alternatively, the dilfroth may be subjected to gravity separation in a series of inclined plate separators ("IPS") in conjunction with countercurrent solvent extraction using added light hydrocarbon diluent. However, these treatment processes still result in bitumen often containing undesirable amounts of solids and water.

More recently, a staged settling process for cleaning dilfroth was developed as described in U.S. Pat. No. 6,746,599, whereby dilfroth is first subjected to gravity settling in a splitter vessel to produce a splitter overflow (raw dilbit) and a splitter underflow (splitter tails) and then the raw dilbit is further cleaned by gravity settling in a polisher vessel for sufficient time to produce an overflow stream of polished dilbit and an underflow stream of polisher sludge. Residual bitumen present in the splitter tails can be removed by mixing the splitter tails with additional naphtha and subjecting the produced mixture to gravity settling in a scrubber vessel to produce an overhead stream of scrubber hydrocarbons, which stream is recycled back to the splitter vessel. However, the polisher sludge may still contain a substantial amount of bitumen (up to about 15% to about 20% of the total feed bitumen). It is suggested in U.S. Pat. No. 6,746,599 that the polisher sludge may be mixed with the diluted splitter tails prior to feeding the splitter tails to the scrubber vessel in an attempt to capture this remaining bitumen.

The very viscous bitumen produced with any of the above naphtha-based froth treatment processes is generally not suitable for most conventional North American refineries, as it has an API gravity of less than 10, i.e., generally around 8-9, and substantial heavy ends content (e.g., about 15-20% asphaltenes). Thus, most bitumen recovered from oil sands extraction must be upgraded in non-conventional refineries, for example, those that might use coking as a first step in the refining process, since most conventional refineries were designed to process much lighter crude oils. Paraffinic-based froth treatment processes can produce a more suitable dry, lighter bitumen but these processes experience high bitumen losses that can significantly affect overall recoveries, primarily due to asphaltene losses.

Further, the bitumen produced with any of the above naphtha-based froth treatment processes generally does not meet pipeline specifications due to its high API and viscosity.

SUMMARY OF THE INVENTION

It was discovered that when practicing the staged settling process for cleaning dilfroth as described in U.S. Pat. No. 6,746,599 on a continuous basis, the mixing of the polisher sludge with the splitter tails could, in some instances, eventually cause problems in overall bitumen recoveries and the quality of the final product (dilbit). Without being bound to theory, it was believed that the degradation in process performance was likely due to the continuous transfer of large amounts of fines from the polisher sludge. These fines, with typical $d_{50}$ of about 10 microns, may exacerbate the formation of the rag layer in the scrubber vessel, which may result in an increase in bitumen loss from the process to the scrubber underflow. Further, when demulsifiers (flocculants) are used in the polisher to aid in the clarification of the diluted bitumen, these demulsifiers will report to the polisher sludge and may also affect the rag layer formation in the scrubber.

However, due to the substantial amounts of bitumen still remaining in the polisher sludge, it is still desirable to be able to recover the bitumen remaining in the in the polisher sludge as cleaned diluted froth. It was discovered that the staged settling process could be modified to overcome these problems while still maintaining acceptable bitumen recoveries.

It was further discovered that the staged settling process could be used to produce two separate cleaned diluted bitumen streams, where each stream would comprise bitumen having different physical properties. In particular, a first stream comprising heavy bitumen having an API gravity less than about 10 could be produced for upgrading in non-conventional refineries and a second stream comprising lighter bitumen having an API gravity greater than about 10 could be produced for upgrading in more conventional refineries. Thus, the overall process could be manipulated to meet either requirement. For example, in instances where the oil sands plant is operating overcapacity, i.e., producing too much of the first stream comprising heavy bitumen for the plant upgrader, e.g., cokers, to handle, it may be desirable to remove the second stream comprising lighter bitumen, which is normally recycled back to the staged settling process, to sell to conventional refineries for upgrading.

Broadly stated, in one aspect of the invention, a modified staged settling process is provided to produce cleaned diluted bitumen having reduced water and solids without unacceptable losses of bitumen. More particularly, a process for removing contaminants, namely water and particulate solids, from hydrocarbon diluent-diluted bitumen froth ("dilfroth") is provided, comprising:

- subjecting the dilfroth to gravity settling in a primary settler to produce an overflow stream of primary raw dilbit, comprising bitumen containing water and some fine solids, and an underflow stream of primary tails, comprising solids, water and residual bitumen;
- removing the overflow stream of primary raw dilbit and subjecting it to gravity settling in a clarifier vessel for sufficient time to produce an overflow first stream of cleaned dilbit and an underflow stream of clarifier sludge;
- diluting the primary tails with hydrocarbon diluent and subjecting the diluted primary tails to gravity settling in a secondary settler to produce an overflow second stream of cleaned dilbit and an underflow stream of secondary tails; and
- removing the clarifier sludge and diluting the clarifier sludge with a hydrocarbon diluent if necessary and subjecting the clarifier tails to gravity separation to produce a third stream of cleaned dilbit.

In one embodiment, the dilfroth has a diluent/bitumen ratio of about 0.4:1 to about 1.2:1. In another embodiment, the diluent/bitumen ratio is about 0.5:1 to about 0.7:1. In another embodiment, the primary tails are diluted with hydrocarbon diluent to give a diluent/bitumen ratio greater than about 2:1 and, in one embodiment, between about 4:1 to about 10:1. In another embodiment, the clarifier sludge is diluted with hydrocarbon diluent to give a diluent/bitumen ratio of at least about 1:1. In one embodiment, the hydrocarbon diluent is naphtha.

In another embodiment, the secondary tails are mixed with the clarifier sludge and, optionally, additional hydrocarbon diluent is added, if needed, to give a diluent/bitumen ratio of at least about 1:1 prior to subjecting the combined mixture to gravity separation to produce the third stream of cleaned dilbit. Hence, any bitumen still remaining in secondary tails can also be recovered. Further, at lower diluent/bitumen ratios, some of the precipitated asphaltenes present in the secondary tails will be redissolved and thus can also be recovered.

In one embodiment the clarifier sludge is subjected to gravity separation in a centrifuge, for example, a disc centrifuge, a scroll centrifuge or a series of disc and/or scroll centrifuges. In another embodiment, other gravity separation means known in the art can be used such as hydrocyclones, cycloseparators, propelled vortex separators and the like. In another embodiment, the underflow stream of secondary tails can be first mixed with the clarifier sludge to provide the naphtha required to reach the target dilution ratio prior to gravity separation. In the alternative, fresh naphtha can be used.

It is understood that the three streams of cleaned dilbit can be pooled to give a single product of cleaned dilbit or, in the alternative, each stream of cleaned dilbit can be treated separately. In one embodiment, all or some of the second stream of cleaned dilbit can be recycled back to the primary settler. In another embodiment, the second stream of cleaned dilbit, which comprises lighter bitumen, can be removed for upgrading in conventional refineries.

In another broad aspect of the invention, a process is provided for producing two separate cleaned diluted bitumen ("dilbit") streams, a first stream comprising heavy bitumen having an API gravity less than about 10 and a second stream comprising lighter bitumen having an API gravity greater than about 10, which lighter bitumen is a suitable refinery grade feed stock. More particularly, a process is provided for removing contaminants, namely water and particulate solids, from hydrocarbon diluent-diluted bitumen froth ("dilfroth") to produce two separate streams of diluted bitumen ("dilbit"), comprising:

- subjecting the dilfroth to gravity settling in a primary settler to produce an overflow stream of primary raw dilbit, comprising bitumen containing water and some fine solids, and an underflow stream of primary tails, comprising solids, water and residual bitumen;
- removing the overflow stream of primary raw dilbit and subjecting it to gravity settling in a clarifier for sufficient time to produce an overflow first stream comprising heavy bitumen having an API gravity less than about 10 and an underflow stream of clarifier sludge; and
- diluting the primary tails with a sufficient amount of hydrocarbon diluent to precipitate a portion of the asphaltenes contained therein and subjecting the diluted primary tails to gravity settling in a secondary settler to produce an overflow second stream comprising light bitumen having an API gravity of greater than about 10 and an underflow stream of secondary tails.

It was surprisingly discovered that when primary tails were treated with hydrocarbon diluent such as naphtha at increasingly high diluent/bitumen ratios, for example, from about 2:1 to about 10:1 or higher, a significant amount of solids and water separated from the residual bitumen in the primary tails. Further, as the ratio of diluent/bitumen increased, more asphaltenes were being rejected (i.e., precipitated out), resulting in a drier and lighter bitumen product having an API gravity greater than about 10. For example, at a naphtha/bitumen ratio of between about 8:1 to about 9:1, approximately 3% of the asphaltenes are rejected and the API gravity of the bitumen in the overflow stream is thus increased to about 14, as compared to the API gravity of whole bitumen, which is generally around 9. Further, in some instances, the water and solids content of this stream are significantly reduced to less than about 0.5% and 0.125%, respectively.

Thus, this lighter bitumen containing stream is considered a fungible bitumen stream, i.e., of a pipelineable quality bitumen stream, which is suitable for upgrading in most conventional refineries.

DESCRIPTION OF THE PREFERRED EMBODIMENT

In one aspect, the invention is concerned with a process for cleaning hydrocarbon diluent-diluted bitumen froth by reducing the content of contaminants, specifically water and solids. In the embodiment shown in FIG. 1, the hydrocarbon diluent is process naphtha.

Figure 1:
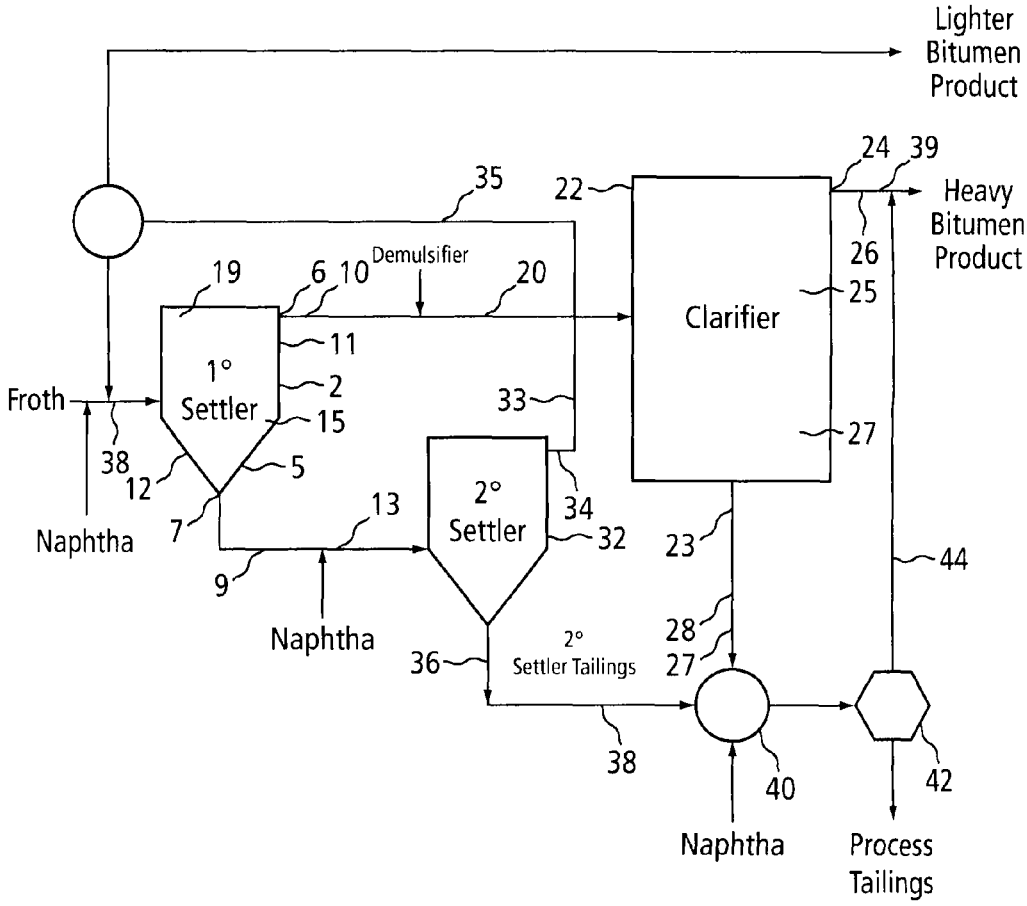
FIG. 1 is a schematic showing one embodiment of the components and steps of the process.

Bitumen froth is initially received from an extraction plant (not shown) for extracting bitumen from oil sand using a water extraction process known in the art. The froth, as received, typically comprises 60% bitumen, 30% water and 10% solids. With reference now to FIG. 1, naphtha is mixed with the froth, for example, in a mixer (not shown) to provide diluent-diluted bitumen froth. In one embodiment, the naphtha may at least partly be supplied by recycling secondary settler naphtha, produced as described below.

The naphtha is supplied in an amount such that the naphtha/bitumen ratio of the diluent-diluted froth ("dilfroth") is preferably in the range 0.5-0.8, most preferably about 0.65.

The dilfroth 38 is fed into the chamber of a gravity settler vessel, referred to as primary settler 2, for example, through an inlet means (not shown). In this embodiment, the primary settler 2 has a conical bottom 5. It has underflow and overflow outlets 7, 6 at its bottom and top ends, respectively. The diluted bitumen froth is temporarily retained in the primary settler 2 for a sufficient length of time to allow a substantial potion of the solids and water to separate from the diluted bitumen (referred to as raw dilbit). Line 9 withdraws a stream of primary settler tails 13 through the underflow outlet 7. Primary settler overflow line 10 collects an overflow stream of raw dilbit.

The rate at which dilfroth 38 is fed to the primary settler 2 and the diameter of the cylindrical section 11 of the primary settler 2 are selected to ensure a preferred flux of <6 m/h, for example, in a range between about 3 to about 6 m/h. The bottom layer 12 of primary settler tails 13 comprises mainly sand and aqueous middlings, said tails containing some hydrocarbons, and the top layer 19 of raw dilbit 20 comprises mainly hydrocarbons containing some water and fines (clay particles). Preferably, the incoming dilfroth 38 may be introduced into the middlings 15 across the cross-section of the primary settler 2, at an elevation spaced below the top layer of raw dilbit 20 and well above the underflow outlet 7.

Preferably, the rates of feeding dilfroth 38 and withdrawing primary vessel tails 13 are controlled to maintain the elevation of the interface generally constant. It is of course desirable to keep the interface away from the bottom of the primary settler 2, to minimize hydrocarbon losses with the primary settler tails 13. For example, one may monitor the composition of the primary settler tails 13 and vary the rates with the objective of keeping the primary settler tails hydrocarbon content below a predetermined value, usually less than 15%.

The raw dilbit 20 produced through the primary settler overflow outlet 6 is pumped through line 10 to a preferably flat-bottomed, vapor-tight tank, referred to as the "clarifier" 22, and subjected to gravity settling therein. A demulsifier may be added to the raw dilbit 20 as it moves through the line 10. The clarifier 22 has a bottom underflow outlet 23 and a top overflow outlet 24.

The raw dilbit and optional demulsifier mixture is temporarily retained for a prolonged period (for example, 24 hours) in the clarifier chamber 25. Water droplets coalesce and settle, together with fines. Clarifier dilbit 39 is removed as an overflow stream from the clarifier 22 through line 26. The clarifier dilbit 39 is found to comprise hydrocarbons, typically containing <3.0 wt. % water and <1.0 wt. % solids. Clarifier sludge 27, comprising water, solids and typically between about 15-20% hydrocarbons, is removed from the clarifier 22 as an underflow stream through line 28.

The primary settler tails 13 produced through the primary settler underflow outlet 7 are pumped through line 9, optionally first to a mixer (not shown), and naphtha is added to the primary settler tails 13 (in the mixer) to produce a secondary settler feed preferably having a naphtha/bitumen ratio in the range 4:1 to 10:1, more preferably about 6:1 to about 8:1 or greater. The primary settler tails 13 are then introduced into secondary settler 32. The primary settler tails are then temporarily retained in the secondary settler 32 (for example for 20 to 30 minutes) and subjected to gravity settling therein.

Figure 2:
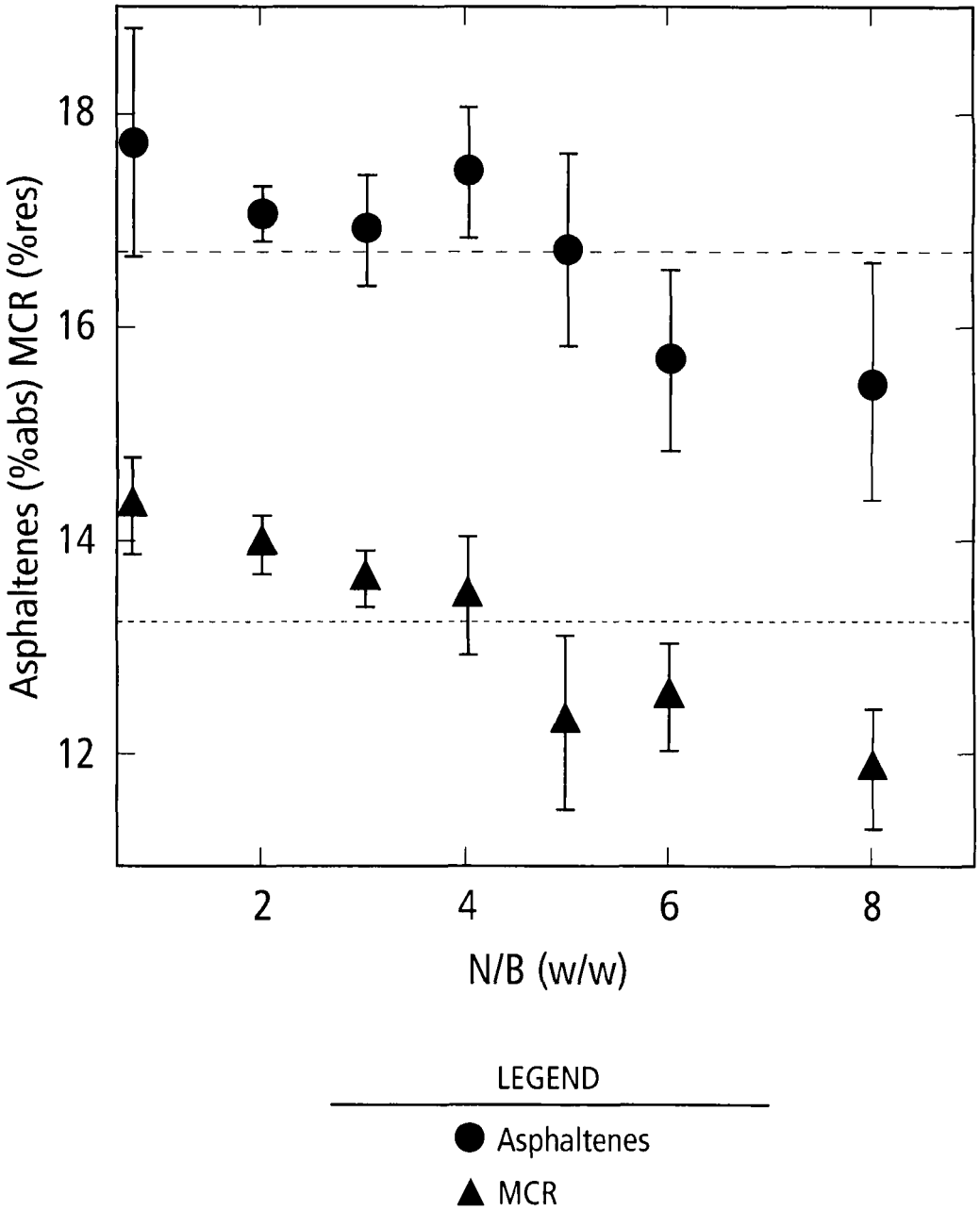
FIG. 2 is a graph showing the effects of naphtha/bitumen (N/B) ratios on the asphaltene content and microcarbon residue of secondary settler overflow.

When the primary settler tails are diluted with naphtha at high enough naphtha/bitumen ratios, it was surprisingly discovered that the asphaltenes present in the primary vessel tails bitumen begin to precipitate out. FIG. 2 is a plot of the % abs of asphaltenes in product bitumen as a function of naphtha/bitumen ratio (w/w) when naphtha is added to the bitumen.

As can be seen in FIG. 2, the amount of asphaltenes present in the bitumen is fairly constant up to a ration of naphtha/bitumen of about 4:1. However, above naphtha/bitumen ratios of 4:1, a continuous trend is observed in which the asphaltenic matter decreases from approaching about 18% by mass to a value approaching 15% by mass. Thus, when the product bitumen is diluted with hydrocarbon diluent such as naphtha to a diluent/bitumen ratio of about 4:1 or greater, the concentration of asphaltenes is significantly reduced. At naphtha/bitumen ratios of about 8:1, the decrease in asphaltenes is about 3%, thereby resulting in a significantly lighter bitumen stream. It is understood that higher naphtha/bitumen ratios, e.g., 10:1 or greater will result in even more asphaltene precipitation/removal from the bitumen, however, overall bitumen recovery will drop. Thus, precipitation of asphaltenes results in overflow stream 33 comprising much lighter bitumen having an API gravity of greater than about 10, for example, about 13-14, and is much lighter than "whole" bitumen which includes the asphaltenes fraction.

Also shown in FIG. 2 is that the amount of microcarbon residue (MCR), which is an indication of the coking potential of the bitumen, versus naphtha/bitumen ratio. MCR also reduced with higher naphtha/bitumen ratios, further indicating that the product bitumen stream is more suitable for upgrading in conventional upgrading refineries.

Figure 3:
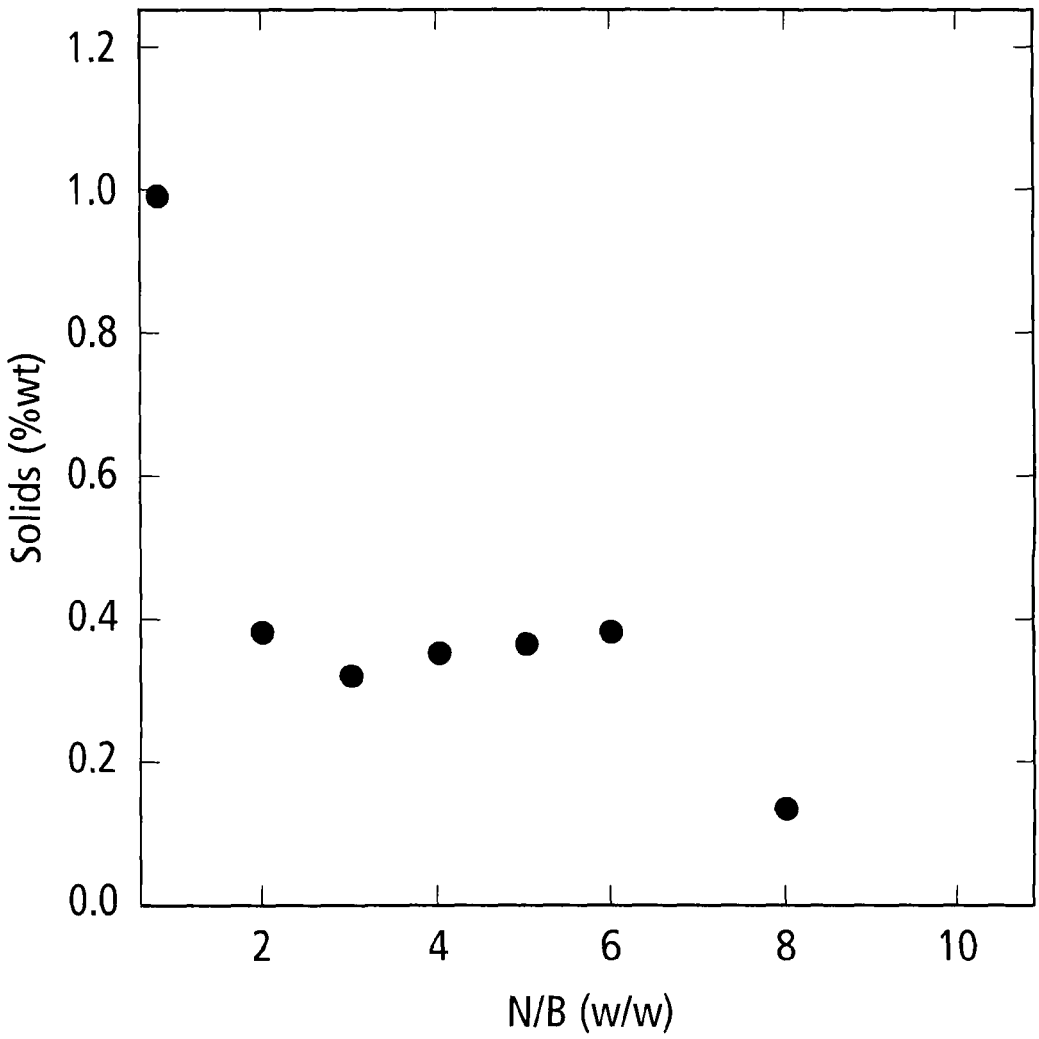
FIG. 3 is a graph showing the effect of naphtha/bitumen (N/B) ratios on the solids content of secondary settler overflow.
Figure 4:
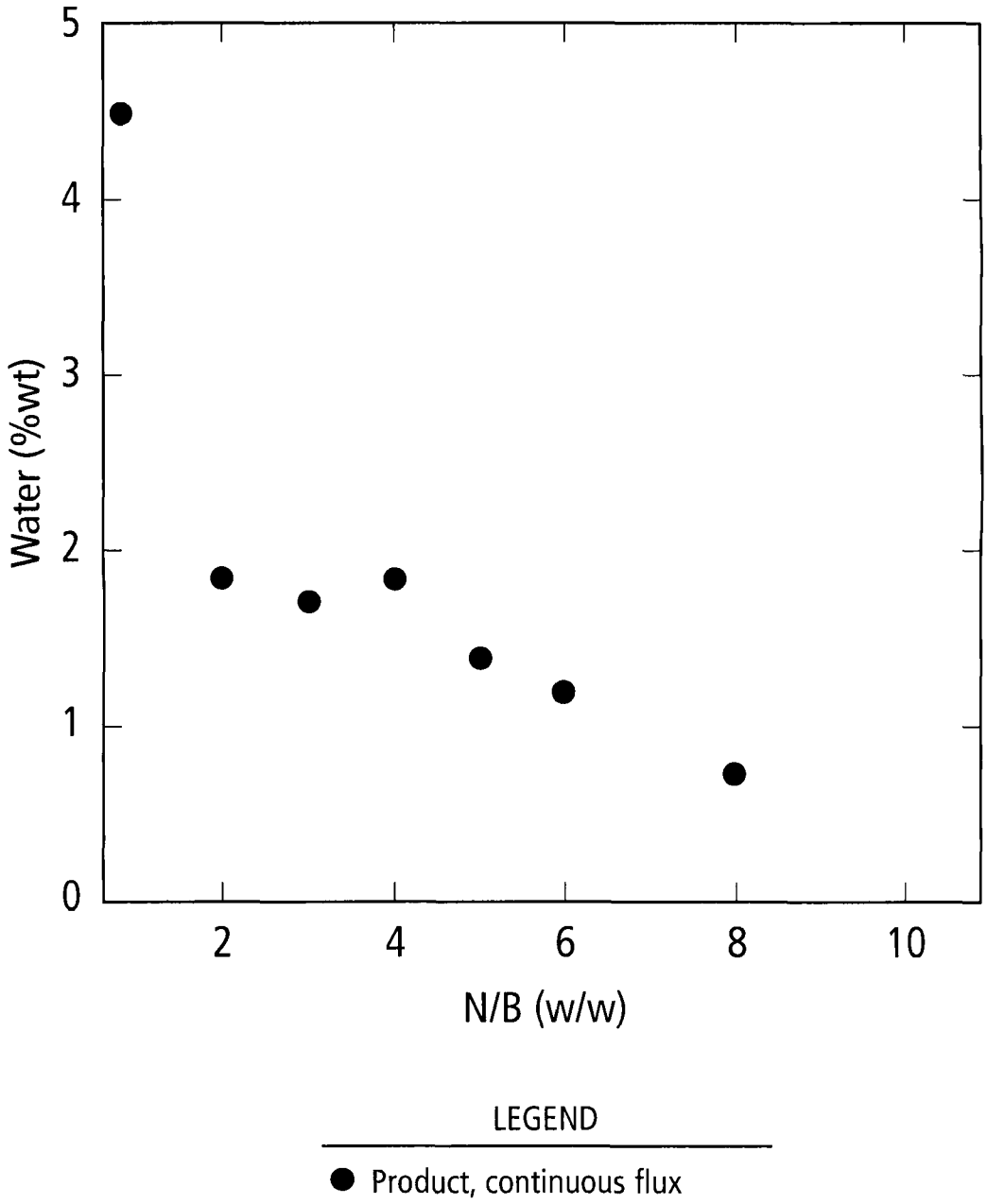
FIG. 4 is a graph showing the effect of naphtha/bitumen (N/B) ratios on the water content of secondary settler overflow.

Further, overflow stream 33 has significantly reduced solids and water, which also makes it a desirable stream for conventional upgrading refineries. FIG. 3 is plot showing the total solids present versus naphtha/bitumen ratio in such a product bitumen stream. At about 2:0 to about 8:1 N/B ratio, the wt % of solids was reduced to below 0.4% and was less than 0.2% at a N/B ratio of 8:0. Further, FIG. 4 shows that such a product bitumen stream has reduced wt % water, falling steadily from a naphtha/bitumen ratio of about 2:1 to about 8:1. At N/B ratio of 8:1, the water content was about 0.8 wt %.

The secondary settler overflow stream 33 of hydrocarbons, mainly comprising naphtha and lighter bitumen, is removed through an overflow outlet 34 and in one embodiment may be recycled through line 35 to primary settler 2. In another embodiment, a slip stream of overflow stream 33 may be removed to be used as a lighter bitumen product for upgrading in conventional refineries. The amount of overflow stream 33 that is removed for upgrading versus the amount of overflow stream 33 that is recycled back to the primary settler 2 will depend upon the overall productivity of the plant. For example, when an excess amount of heavy bitumen is being produced, the upgrading facilities which process heavy bitumen may be overcapacity. Thus, instead of interrupting the production of dilbit, a portion of the lighter bitumen stream can be removed for upgrading at other conventional refineries.

Secondary settler underflow stream of secondary settler tails 36, comprising water and solids containing some hydrocarbons, is removed via line 38 and may be mixed with clarifier sludge 27 in mixer 40 for further processing. As mentioned, there is a significant amount of hydrocarbons still present in the clarifier sludge 27. While the amount of bitumen present in the secondary settler tails 36 is significantly less, nevertheless, secondary settler tails can be mixed with clarifier sludge 27 to capture some of the bitumen still remaining therein. Further, mixing the clarifier sludge 27 with the secondary settler tails 36 provides additional diluent (e.g., naphtha) to the clarifier sludge. It is understood, however, that additional naphtha could also be added.

Figure 5:
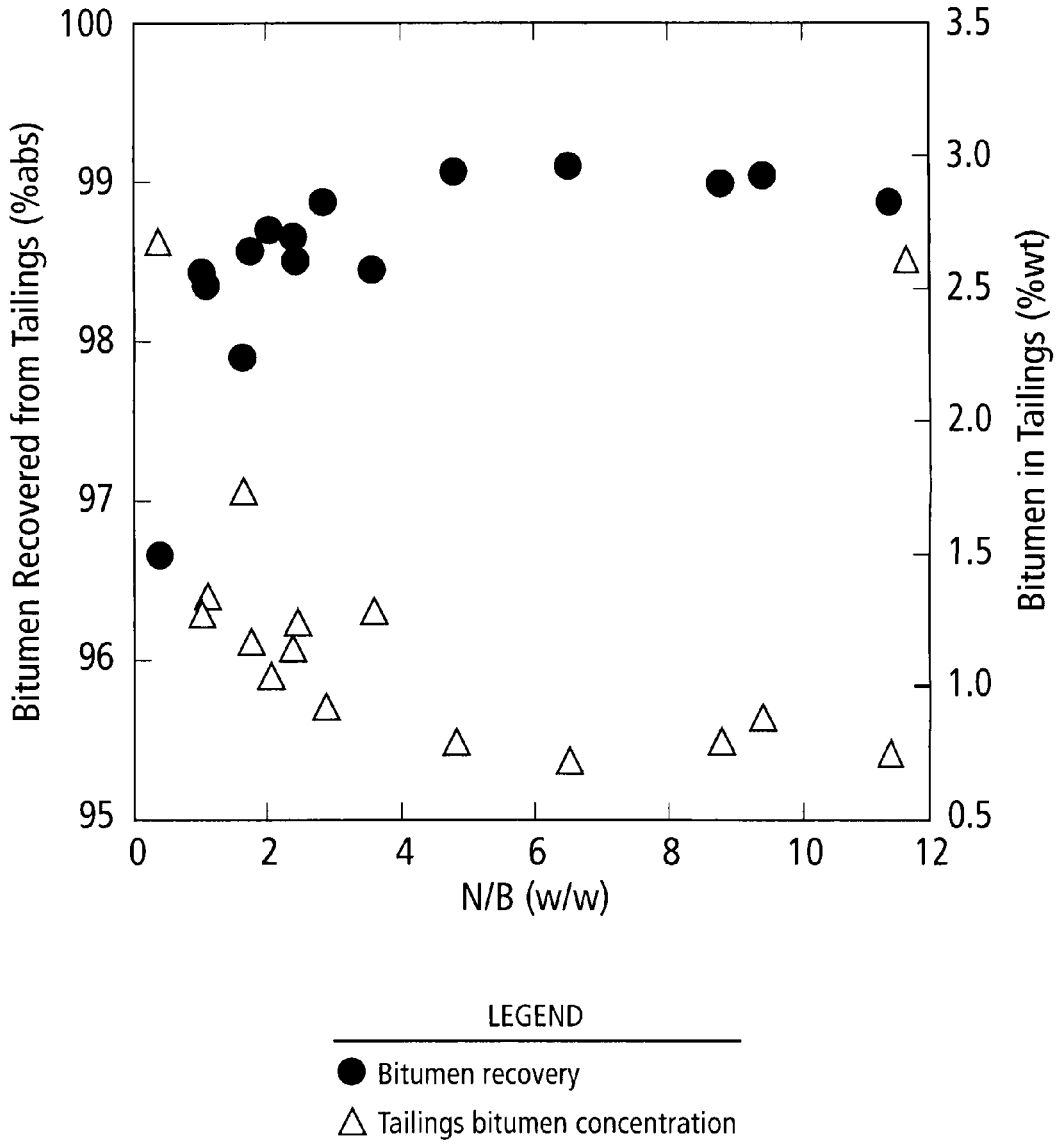
FIG. 5 is a graph showing the effect of naphtha/bitumen (N/B) ratios on bitumen recovery from clarifier sludge and secondary settler tails and the % by weight of bitumen remaining in the final tailings.

FIG. 5 illustrates the effectiveness of dilution centrifugation on bitumen recovery from clarifier sludge mixed with secondary settler tails (tailings). In particular, it can be seen that most of the bitumen is recovered (i.e., 96.5%) at a fairly low naphtha/bitumen ratio of about 0.5:1. However, at higher naphtha/bitumen ratios, e.g., 2:1 or greater, bitumen recovery approached 99% or better. Further, it can be seen that the amount of bitumen remaining in the centrifuge tailings could be reduced to less than 1% at higher naphtha/bitumen ratios.

The bitumen in the combined underflows can be removed by gravity separation in a gravity separator such as disc centrifuge 42. Of course, other gravity separators known in the art can also be used. Further, a series of gravity separators can be used. The diluted bitumen product 44 can be pooled with clarifier dilbit 39 or can remain a separate stream for further upgrading.

EXAMPLE 1

A pilot plant simulating the embodiment as shown in FIG. 1 was tested and the material balance data recorded during steady state conditions using bitumen froth comprising 64% bitumen, 26% water and 11% solids. The resulting data is shown in Table 1. The pilot plant was operated at an overall N/B of about 1.2:1 and the N/B ratio in the secondary settler was about 9. Also, a portion of the secondary settler overflow was recycled back to the primary settler to provide diluent to give a diluted bitumen froth (dilfroth) having an N/B ratio of about 0.6:1 and an overall N/B ratio of about 1.2:1. It is understood, however, that the amount of secondary settler overflow that is recycled is also dependent upon the amount of light product that is used directly for upgrading at any given time during bitumen froth processing. It is understood that some of the light stream can be withdrawn as product with the remainder recycled to the primary settler feed to provide appropriate dilution of the froth.

The secondary settler and clarifier underflows were processed via dilution centrifugation to recovery the remaining bitumen therein, which bitumen was then blended with the clarifier overflow product. To maintain the integrity of the bitumen, the centrifugation process was run at an N/B ratio of less than 2 to optimize recovery while avoiding asphaltene rejection. The requisite dilution is in part provided from the naphtha in the secondary settler tails. Additional make-up naphtha may be required to optimize bitumen recovery.

TABLE 1

| | 1° Settler Feed | 1° Settler O/F | 1° Settler U/F | 2° Settler O/F | 2° Settler U/F | Clarifier O/F | Clarifier U/F | DC Feed | DC Tails | DC Product |
|---|---|---|---|---|---|---|---|---|---|---|
| Naphtha % | 28.17 | 35.38 | 11.99 | 89.37 | 5.47 | 36.37 | 26.39 | 19.76 | 2.82 | 59.3 |
| Bitumen % | 46.98 | 58.99 | 20.0 | 10.0 | 0.61 | 60.66 | 44.0 | 9.88 | 1.41 | 29.65 |
| Water % | 17.28 | 5.0 | 44.84 | 0.5 | 61.68 | 2.3 | 29.3 | 48.33 | 65.48 | 8.29 |
| Solids % | 7.57 | 0.63 | 23.16 | 0.125 | 32.23 | 0.66 | 0.31 | 22.03 | 30.58 | 2.07 |

O/F = Overflow
U/F = Underflow
DC = dilution centrifuge

The quality of the blended clarifier product (clarifier overflow+DC product) comprised 39.45% naphtha, 56.5% bitumen, 3.1% water and 0.85% solids, which meets current upgrading specifications on water and solids content (for non-conventional upgrading). The N/B is approximately 0.7, which is slightly higher than current centrifuge plant operations.

From the foregoing description, one skilled in the art can easily ascertain the essential characteristics of this invention, and without departing from the spirit and scope thereof, can make various changes and modifications of the invention to adapt it to various usages and conditions.

What is claimed:

1. A process for removing contaminants, namely water and particulate solids, from hydrocarbon diluent-diluted bitumen froth to produce hydrocarbon diluent-diluted bitumen, comprising:

subjecting the hydrocarbon diluent-diluted bitumen froth to gravity settling in a primary settler to produce an overflow stream of primary raw hydrocarbon diluent-diluted bitumen, comprising bitumen containing water and some fine solids, and an underflow stream of primary tails, comprising solids, water and residual bitumen;

removing the overflow stream of primary raw hydrocarbon diluent-diluted bitumen and subjecting it to gravity settling in a clarifier vessel for sufficient time to produce an overflow first stream of cleaned hydrocarbon diluent-diluted bitumen and an underflow stream of clarifier sludge;

diluting the primary tails with hydrocarbon diluent and subjecting the diluted primary tails to gravity settling in a secondary settler to produce an overflow second stream of cleaned hydrocarbon diluent-diluted bitumen and an underflow stream of secondary tails; and mixing the clarifier sludge and the secondary tails to form a mixture of clarified sludge and secondary tails, diluting the mixture with a hydrocarbon diluent and subjecting the diluted mixture to gravity separation to produce a third stream of cleaned hydrocarbon diluent-diluted bitumen and cleaned tails.

2. The process as claimed in claim 1, wherein the hydrocarbon diluent-diluted bitumen froth has a hydrocarbon diluent/bitumen ratio of about 0.4:1 to about 1.2:1.

3. The process as claimed in claim 2, wherein the hydrocarbon diluent-diluted bitumen froth has a hydrocarbon diluent/bitumen ratio of about 0.5:1 to about 0.7:1.

4. The process as claimed in claim 1, wherein the primary tails are diluted with hydrocarbon diluent to give a diluent/bitumen ratio greater than about 2:1.

5. The process as claimed in claim 1, wherein the primary tails are diluted with hydrocarbon diluent to give a diluent/bitumen ratio between about 4:1 to about 10:1.

6. The process as claimed in claim 1, wherein the mixture is diluted with hydrocarbon diluent to give a diluent/bitumen ratio of at least about 0.5:1.

7. The process as claimed in claim 1, wherein the mixture is subjected to separation in a centrifuge.

8. The process as claimed in claim 7, wherein the centrifuge is a disc centrifuge, a scroll centrifuge or a series of disc and/or scroll centrifuges.

9. The process as claimed in claim 1, wherein the mixture is subjected to separation in a separate gravity separator selected from the group consisting of hydrocyclones, cycloseparators, propelled vortex separator and combinations thereof.

10. The process as claimed in claim 1, wherein the hydrocarbon diluent is naphtha.

11. A process for removing contaminants, namely water and particulate solids, from hydrocarbon diluent-diluted bitumen froth to produce two separate streams of bitumen, comprising:

subjecting the hydrocarbon diluent-diluted bitumen froth to gravity settling in a primary settler to produce an overflow stream of primary raw hydrocarbon diluent-diluted bitumen, comprising bitumen containing water and some fine solids, and an underflow stream of primary tails, comprising solids, water and residual bitumen;

removing the overflow stream of primary raw hydrocarbon diluent-diluted bitumen and subjecting it to gravity settling in a clarifier vessel for a sufficient time to produce an overflow first stream comprising heavy bitumen having an API gravity less than about 10 and an underflow stream of clarifier sludge;

diluting the primary tails with a sufficient amount of hydrocarbon diluent to precipitate a portion of the asphaltenes contained therein and subjecting the diluted primary tails to gravity settling in a secondary settler to produce an overflow second stream comprising light bitumen having an API gravity of greater than about 10 and an underflow stream of secondary tails;

combining the secondary tails and clarifier sludge, diluting the combined secondary tails and clarifier sludge with hydrocarbon diluent to give a diluent/bitumen ratio of about 2:1 to about 10:1 or higher and subjecting the diluted secondary tails and clarifier sludge to gravity separation to produce a third stream of cleaned hydrocarbon diluent-diluted bitumen and cleaned tails having less than 1 wt % bitumen.

12. The process as claimed in claim 11, wherein the primary tails are diluted with hydrocarbon diluent to give a diluent/bitumen ratio from about 2:1 to about 10:1 or higher.

13. The process as claimed in claim 11, wherein the primary tails are diluted with hydrocarbon diluent to give a diluent/bitumen ratio from about 5:1 to about 9:1 or higher.

14. The process as claimed in claim 11, wherein the primary tails are diluted with hydrocarbon diluent to give a diluent/bitumen ratio from about 8:1 to about 9:1.

15. The process as claimed in claim 11, wherein the hydrocarbon diluent is naphtha.

* * * * *